US008027497B2

(12) United States Patent
Klemenz et al.

(10) Patent No.: US 8,027,497 B2
(45) Date of Patent: Sep. 27, 2011

(54) HEARING DEVICE WITH RECHARGEABLE BATTERY AND MOVABLY MOUNTED CHARGING CONTACTS

(75) Inventors: Harald Klemenz, Singapore (SG); Thomas Lotter, Nürnberg (DE); Benjamin Schmidt, Nürnberg (DE); Herve Schulz, Erlangen (DE); Erwin Singer, Eckental (DE); Roland Weigert, Erlangen (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 999 days.

(21) Appl. No.: 11/933,491

(22) Filed: Nov. 1, 2007

(65) Prior Publication Data

US 2008/0118093 A1 May 22, 2008

(30) Foreign Application Priority Data

Nov. 8, 2006 (DE) ..... 10 2006 052 713

(51) Int. Cl.
*H04R 25/00* (2006.01)

(52) U.S. Cl. ..... 381/323; 381/322

(58) Field of Classification Search ..... 381/312, 381/322, 323; 320/107, 112, 114; 439/38–40
See application file for complete search history.

(56) References Cited

U.S. PATENT DOCUMENTS

| | | | | |
|---|---|---|---|---|
| 4,186,335 | A * | 1/1980 | Cahill | 320/103 |
| 5,253,300 | A * | 10/1993 | Knapp | 381/323 |
| 5,610,494 | A | 3/1997 | Grosfilley | |
| 5,754,124 | A * | 5/1998 | Daggett et al. | 340/908.1 |
| 6,498,455 | B2 | 12/2002 | Zink et al. | |
| 6,777,910 | B2 * | 8/2004 | Small | 320/106 |

* cited by examiner

*Primary Examiner* — Tuan Nguyen
(74) *Attorney, Agent, or Firm* — Schiff Hardin LLP

(57) ABSTRACT

A hearing device that is operated with a rechargeable battery pack has at least one contact element that is fashioned to accept a charging current in electrical connection with an external charging device. The contact element is resiliently mounted at the hearing device and can be pressed onto a charging contact of the external charging device during a charging state under the application of a positive force. The contact element is located in a first position in an operating state or rest state of the hearing device, and is moved into a second position in the charging state.

11 Claims, 5 Drawing Sheets

HEARING DEVICE WITH RECHARGEABLE BATTERY AND MOVABLY MOUNTED CHARGING CONTACTS

BACKGROUND OF THE INVENTION

1. Field of the Invention

The present invention concerns a hearing aid of the type having a movable contact element which can be operated with a battery pack 2. Description of the Prior Art Due to the development of more powerful rechargeable battery pack power supplies, it is possible to equip and to operate hearing devices with such a battery pack. A problem that results is that the battery pack must be recharged at periodic intervals, which typically occurs in a charging device. For this purpose, the battery pack typically must be removed from the device and be placed in the charging device. Since hearing devices, in particular in-the-ear (ItE) hearing devices, are quite small, it is difficult to remove the battery pack from the device. This is particularly true for older hearing device wearers. Hearing devices were therefore developed which exhibit a permanently installed battery pack. To allow the battery pack in the hearing device to be charged, it is known to design the battery pack so that it can be charged by induction. For example, such a hearing device with battery pack that can be charged via induction is described in U.S. Pat. No. 6,498,455.

A battery pack that can be charged by induction is complicated in terms of design and requires additional space (which is always tightly allocated in a hearing device). The charging by induction also requires a complicated charging device and a high energy consumption.

EP 0630 549 B1 discloses a hearing device with chargeable battery pack wherein the device housing has openings through which the charging pins of a charging device can contact the charging contacts of the battery pack. The charging pins of the charging device protrude into the openings in the hearing device housing upon charging. This has the disadvantage that dirt can get into the openings during usage of the hearing device. This can lead to a contamination of the charging contacts, which can make further charging procedures more difficult.

SUMMARY OF THE INVENTION

An object of the present invention is to provide a hearing device which avoids the cited disadvantages of prior art devices.

This object is achieved in accordance with the invention by a hearing device that can be operated with a rechargeable battery pack and that has at least one contact element that is fashioned to accept a charging current in electrical connection with an external charging device, the contact element being flexibly arranged at the hearing device is prestressed (i.e., a positive mating force is automatically applied) pressed onto a charging contact of the external charging device during charging.

Two situations are to be distinguished with regard to the contact element of the hearing device: an operating or rest state (non-charging state), in which the hearing device is not being charged, and a charging state in which the hearing device is charged by the charging device. According to the present invention, the contact element is located in a first position in the operating or rest state of the hearing device and is located in a second position during the charging state.

In the context of the present invention, the term "battery pack" encompasses any rechargeable battery, capacitor or the like which can supply the hearing device with electrical energy. The contact element can be a contact surface, a contact pin, a contact element, a contact clamp or any other contact which is suitable for acceptance of a charging current. In the broadest sense, "flexibly arranged at the hearing device" means movable, flexible or deformable, such that the contact element under prestress can be pressed against a corresponding charging contact of an external charging device which acts as a counter bearing.

The contact element can be fashioned such that it automatically returns again from the second position into the first position after the end of the charging procedure and after removal of the hearing device from the charging device.

A corresponding opening in the housing of the hearing device can be provided for the contact element. According to a preferred aspect of the present invention, in the first position (i.e. operating or rest state) the outer surface of the contact element terminates essentially flush with the housing surface of the hearing device housing. This is aesthetically appealing, and has the advantage of preventing dirt from reaching the inside of the housing of the hearing device at this point.

In a further embodiment, of the present invention, in the second position (i.e. during the charging state) the contact element protrudes from the hearing device housing. For example, the contact element can be fashioned as a pin which can be mounted at the hearing device to allow it to move so that, in the second position, it is pushed through an opening in the hearing device housing and protrudes from the housing. In this state the contact element can then be contacted without, difficulty by the charging contact of the external charging device.

In another embodiment of the present invention, in the second position the contact element can be lowered into a recess of the hearing device housing. This is advantageous for use with a charging device having a pin-like contact that can then catch in the recess of the hearing device housing and contact the contact element.

According to a preferred embodiment of the present invention, the contact element is provided in a guide device. For example, this guide device can be fashioned as a type of shaft in which a pin-like contact element is directed in a movable manner.

According to a further embodiment of the present invention, the contact element is associated with a spring element and a locking mechanism such that the contact element can be brought from the first position into the second position by external pressing and from the second position into the first position by a subsequent pressing. This type of mechanism is similar to the pushbutton of a ballpoint pen: by pressing once, the contact element is conveyed from the first form into the second form; it is conveyed from the second position into the first position via another press. For this the contact element can likewise be associated with a locking mechanism. The locking mechanism can be executed integrally with the spring element or can comprise separate elements. For example, the locking mechanism can be formed by a locking element (for example a locking pin) and a locking projection. The locking mechanism can be one part or multiple parts.

The contact element can be executed as a contact pin.

According to a preferred aspect of the present invention, the contact element is associated with a return element that causes the contact element to be returned from the second position into the first position after a charging procedure. For example, such a return element can be an resiliently deformable element (for example a spring, in particular a spiral spring) or an resiliently deformable material (for example foamed material or silicon rubber) which is deformed upon engagement of the hearing device with the charging device and, upon exertion of a return force, presses the contact element of the hearing device against the corresponding charging contact of the charging device. The return element moves the contact element back into the first position upon removal of the hearing device from the charging device. Naturally, it is also possible for the contact element itself to simultaneously act as the return element, for example when it is fashioned as a flexible clip.

According to a preferred embodiment of the present invention, the hearing device also has a switch, with the contact element being moved from the first position into the second position and vice versa by the switch. According to a preferred version of this embodiment, the switch is actuated upon the hearing device being brought in contact with the external charging device, for example upon placement of the hearing device in a receptacle provided for this in the charging device.

A charging device can also be provided for the inventive hearing device. During a charging state a contact element of the hearing device can be pressed against a charging contact of the charging device by being prestressed.

In order to press the contact element of the hearing device against the charging contact of the charging device with initial tension, the charging device can have a magnetic element, so the hearing device can be pressed against the charging device with magnetic force. For example, a permanent magnet or an electromagnet that attracts a magnetic element in the hearing device (for example the battery pack) can be provided in the charging device.

The contact element of the hearing device can be pressed, by being prestressed, against the charging contact of the hearing device via spring force. For this purpose, the charging device can have a corresponding spring element or tension element (for example a clamp) in order to clamp the hearing device.

The charging device can exhibit a receptacle for the hearing device which, by virtue of its spatial design, predetermines a positive charging position of the charging device. The receptacle can be adapted to the shape of the hearing device. For this purpose, the receptacle can conform to a region of the hearing device specific to a wearer (this in particular applies for ItE units), or the receptacle can be adapted to a region of the hearing device that is not specific to a wearer. In terms of shape, the receptacle can be fashioned complementary to the surface shape of the hearing device.

An adapter element can be provided, with the receptacle being adapted to the adapter element and the adapter element being adapted to a user-specific region of the hearing device. It is thus possible to produce a single charging device type for a number of individual hearing devices shaped specific to the wearer and, to respectively equip the charging device type with an adapter that is adapted to the individual hearing device.

According to a further aspect of the present invention, the correct polarity of the charging contact is predetermined by the charging position of the hearing device in the receptacle of the charging device.

The invention also encompasses is a hearing device with two or more contact elements (for example plus and minus poles), with at least one contact element arranged flexibly at the hearing device in the manner described above.

DESCRIPTION OF THE PREFERRED EMBODIMENTS

Figure 1:
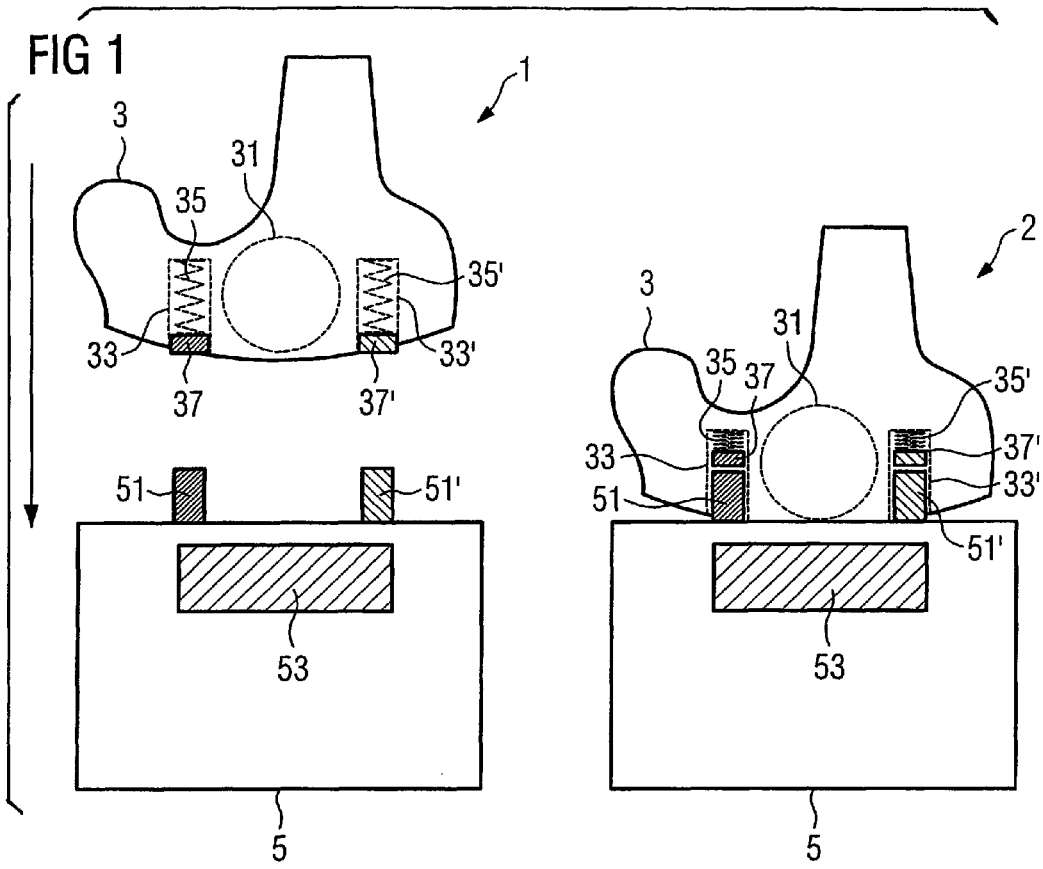
FIG. 1 is a schematic representation of a first embodiment of an inventive hearing device and associated charging device.

Shown in FIG. 1 are an inventive hearing device 3 and associated charging device 5 in a first position 1 and a second position 2. The hearing device 3 is an ItE device and has a battery pack 31. Two openings with receptacles 33 and 33' are provided in its housing. Return elements 35 and 35' executed as spiral springs are located in the respective receptacles 33 and 33', and located at the ends of the return elements 35 and 35' are respective contact elements 37 and 37'. The contact elements 37, 37' are mounted in the receptacles 33, 33' such that they can move and, in the first position (i.e. in an operating or rest state of the hearing device without interaction with the charging device), are located in a position so the outer surface of each contact element 37, 37' is essentially flush with the housing of the hearing device 3 so that the openings are covered by the contact elements 37, 37'. This advantageously prevents that cerumen or dirt from reaching the interior of the hearing device. The charging device 5 has two charging contacts 51 and 51' fashioned as pins or posts and a magnet 53.

In a second position (i.e. during a charging procedure), the hearing device is brought into contact with the charging device. The magnet 53 attracts the battery pack 31 and thus holds the hearing device 3 on the charging contacts 51, 51' fashioned as pins. The charging contacts 51, 51' are in electrical connection with the contact elements 37, 37' of the hearing device, with the contact elements 37, 37' being pushed into the receptacles 33, 33' and the return elements 35 and 35' fashioned as spiral springs being compressed. The contact elements 37', 37' are pressed against the charging contacts 51, 51' by prestress due to the magnetic force of the magnet 53 and the spring force of the return elements 35, 35'.

Because the charging contacts 51, 51' (which are fashioned as pins) plug into the receptacles 33, 33', a good engagement of the hearing device on the charging device is ensured. In order to prevent an accidental attempt to charge with an incorrect polarity of the contacts, the two charging contacts 51, 51' of the charging device and the associated housing openings or receptacles 33, 33' should be of different sizes or be shaped differently, in order to permit only one alignment.

It is likewise possible for the charging device to exhibit a receptacle that is shaped complementary to the hearing device (not shown).

Figure 2:
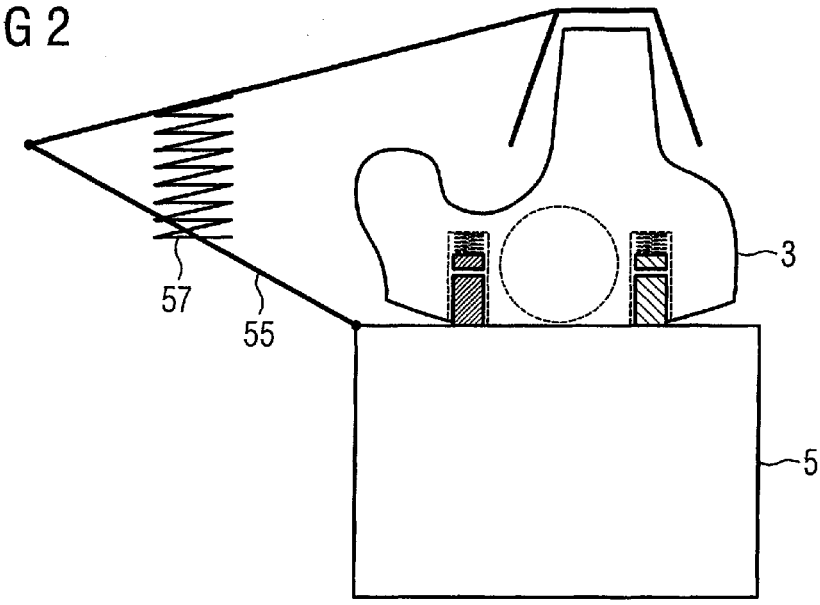
FIG. 2 is a schematic representation of a second embodiment of an inventive hearing device and associated charging device.

The hearing device 3 shown in FIG. 2 is identical with the hearing device of the embodiment from FIG. 1 except the charging device 5 has no magnet. Instead, a clamp 55 is provided is compressed by a spring 57 so that the hearing device 3 can be clamped between the clamp 55 and the charging device 5. It is noted that the clamp 55 is shown significantly simplified and schematically.

Figure 3:
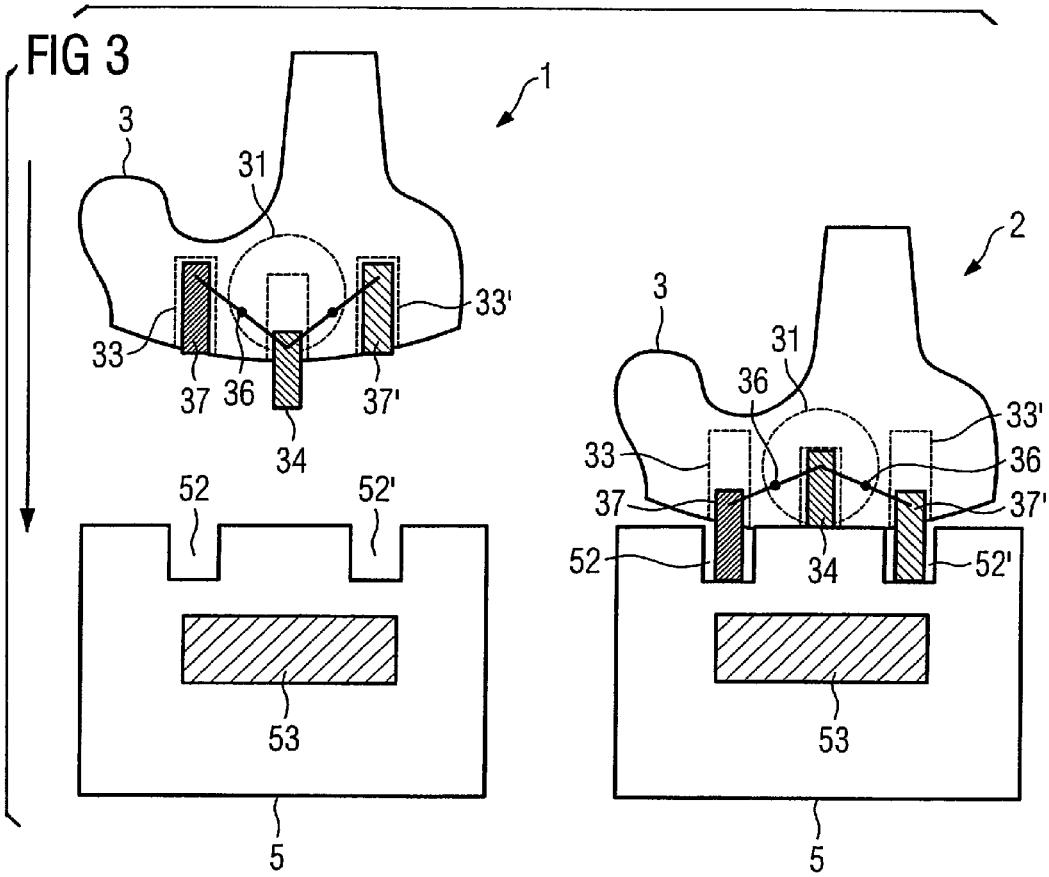
FIG. 3 is a schematic representation of a third embodiment of an inventive hearing device and associated charging device.

A further embodiment of the hearing device 3 and associated charging device is shown in FIG. 3. The hearing device 3 is shown in a first position 1 (i.e. in an operating or rest state) and in a second position 2 (i.e. in a charging state). The hearing device 3 has a slider switch 34 that is connected via an actuating element 36 with the contact elements 37, 37' fashioned as contact pins. The contact elements 37, 37' are mounted so as to move in the receptacles 33, 33'. A magnet 53 in the charging device 5 attracts the hearing device (namely, the battery pack 31) therein into a charging position 2. The switch 34 is thereby actuated and the contact elements 37, 37' are moved out from the receptacles 33, 33' by the actuating element 36 such that said contact elements 37, 37' protrude from the hearing device housing. In the second position 2 the contact elements 37 (fashioned as contact pins) of the hearing device 3 are accepted by charging contacts 52, 52' of the charging device 5 that are fashioned as sockets.

Figure 4:
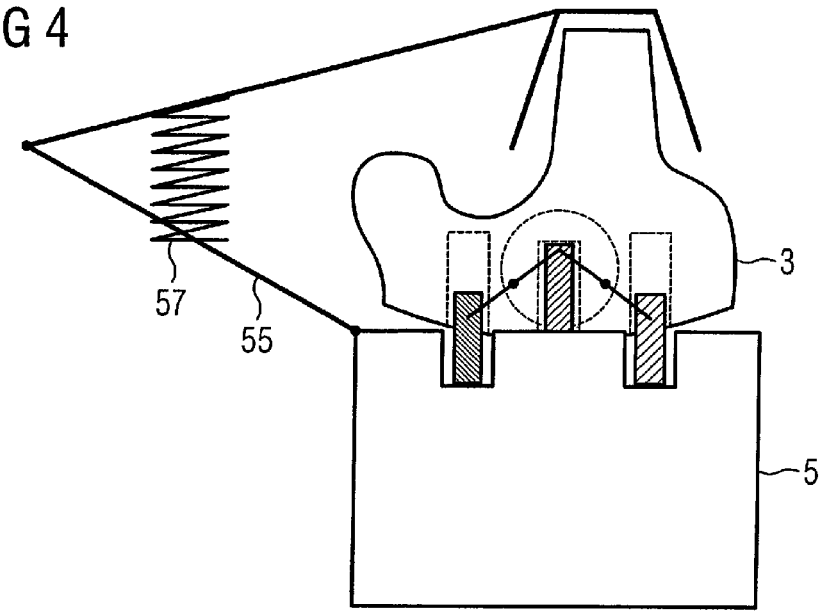
FIG. 4 is a schematic representation of a fourth embodiment of an inventive hearing device and associated charging device.

An alternative embodiment of the charging device 5 is shown in FIG. 4, wherein the hearing device 3 is identical to the hearing device of the embodiment from FIG. 3, but as already described above in FIG. 2, the charging device 5 shown in FIG. 4 has a clamp 55 which is compressed by a spring 57, such that the hearing device 3 can be clamped between the charging device 5 and the clamp 57.

Figure 5:
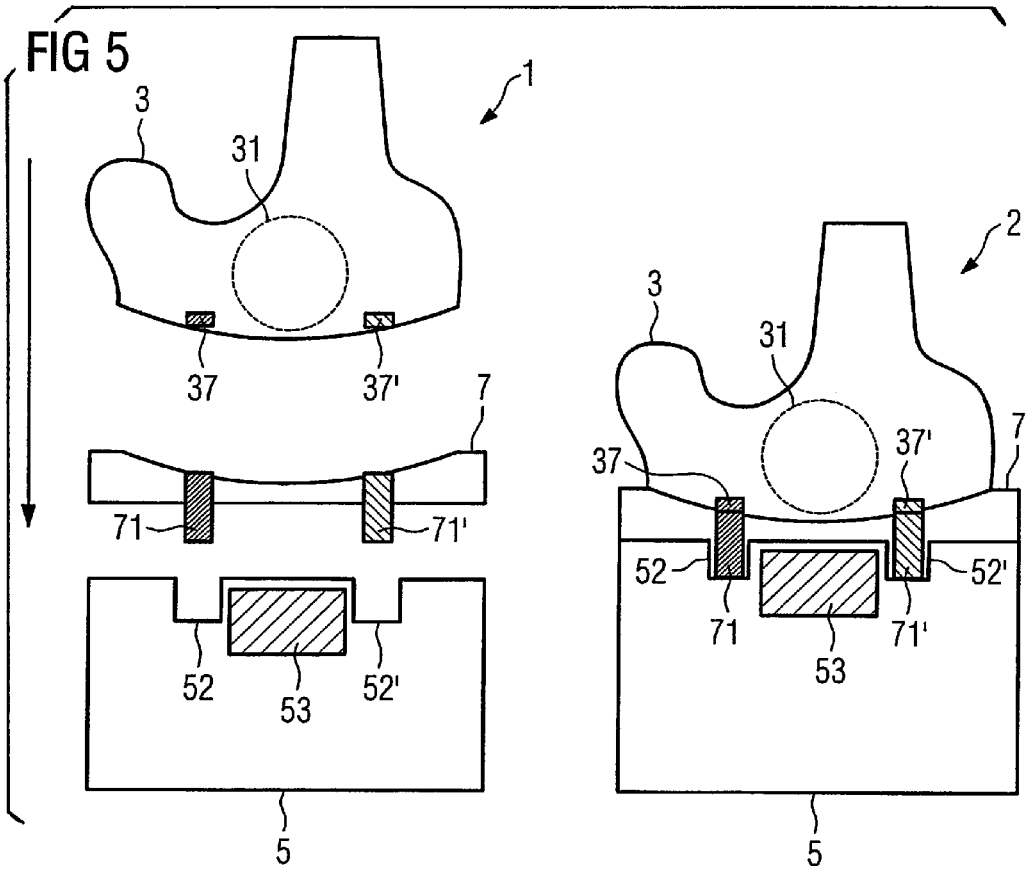
FIG. 5 is a schematic representation of a fifth embodiment of an inventive hearing device and associated charging device.

A further embodiment of a hearing device 3 and a charging device 5 is shown in FIG. 5, wherein the charging device 5 has a receptacle for an adapter 7 that conforms in shape to the hearing device 3. The hearing device 3, the adapter 7 and the charging device 5 are shown in a first position 1 and a second position 2 (charging position). The charging device 5 has charging contacts 52, 52' fashioned as charging sockets that receive respective contact pins 71, 71' of the adapter 7. In the charging position 2 the contact pins 71, 71' of the adapter 7 are in electrical contact with the contact elements 37, 37' of the hearing device 3. The battery pack 31 of the hearing device 3 is attracted by a magnet 53 in the charging device such that the contact elements 37, 37' are pressed onto the charging contacts 52, 52' of the charging device 5 under prestress (positive force) by the contact pins 71, 71' of the adapter 7.

Figure 6:
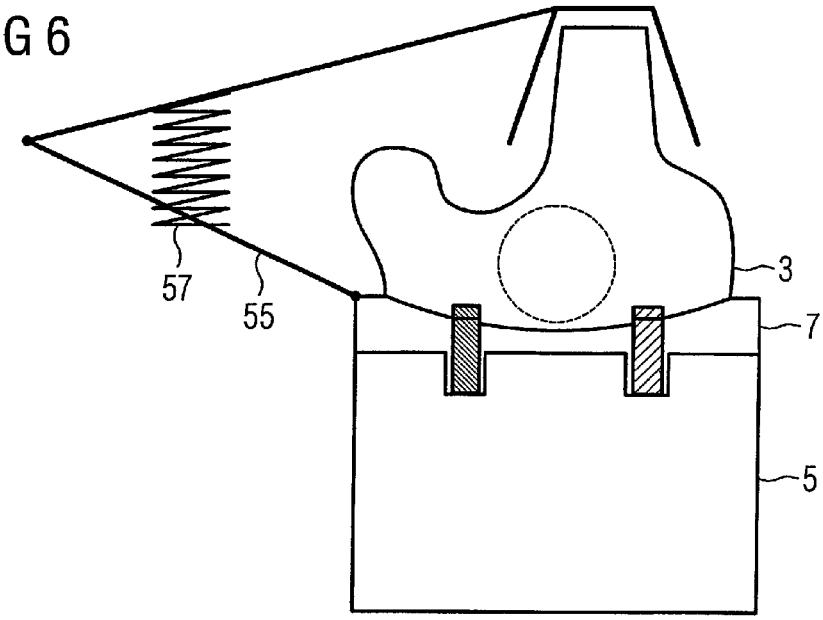
FIG. 6 is a schematic representation of a sixth embodiment of an inventive hearing device and associated charging device.

An alternative embodiment is shown in FIG. 6, wherein (as described above in connection with FIGS. 2 and 4) the arrangement has a clamp 55 that can be composed by a spring 57 so that the hearing device 3 can be clamped between the adapter 7 and the clamp 55.

Figure 7:
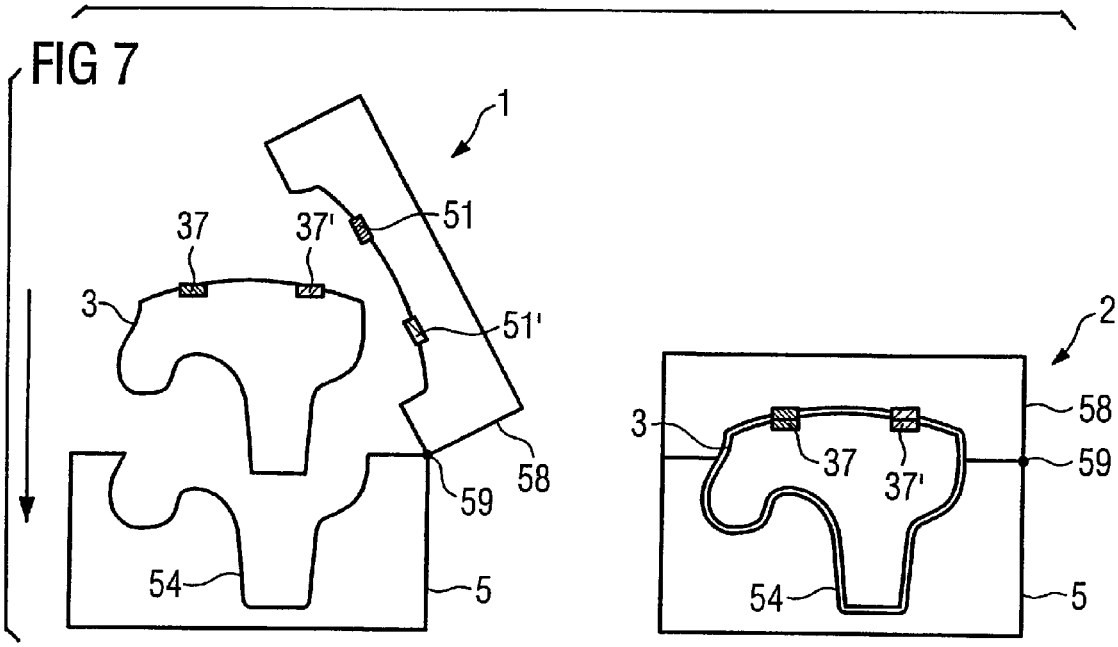
FIG. 7 is a schematic representation of a seventh embodiment of an inventive hearing device and associated charging device.

An inventive hearing device 3 with a further embodiment of a charging device 5 is shown in a first position 1 and a second position 2 (charging position) in FIG. 7. The charging device 5 has a receptacle 54 confirming in shape to the hearing device 3, in which receptacle 54 the hearing device 3 can be accommodated. A cover 58 contains the charging device-side charging contacts 51, 51' which, in the charging position 2, are in electrical connection with the contact elements 37, 37' of the hearing device 3. The cover 58 is movably coupled by a hinge 59 at the main body of the charging device 5. The cover 58 can have a latch element (not shown), for example a snap latch or a magnetic latch, so that the hearing device 3 is clamped in the closed charging device 5 and the contact elements 37, 37' of the hearing device are pressed against the charging contacts 51, 51' of the charging device under positive force.

Figure 8:
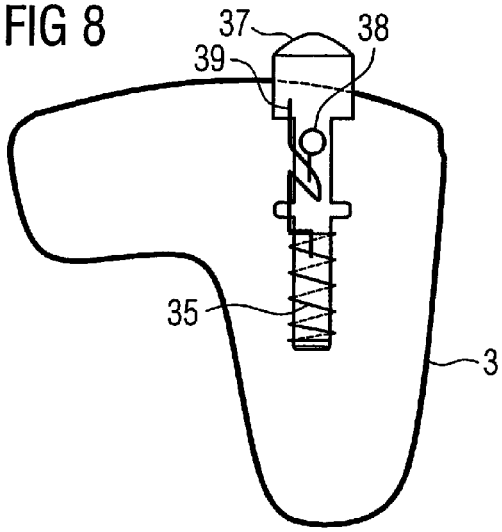
FIG. 8 is a schematic representation of an eighth embodiment of an inventive hearing device.
Figure 9:
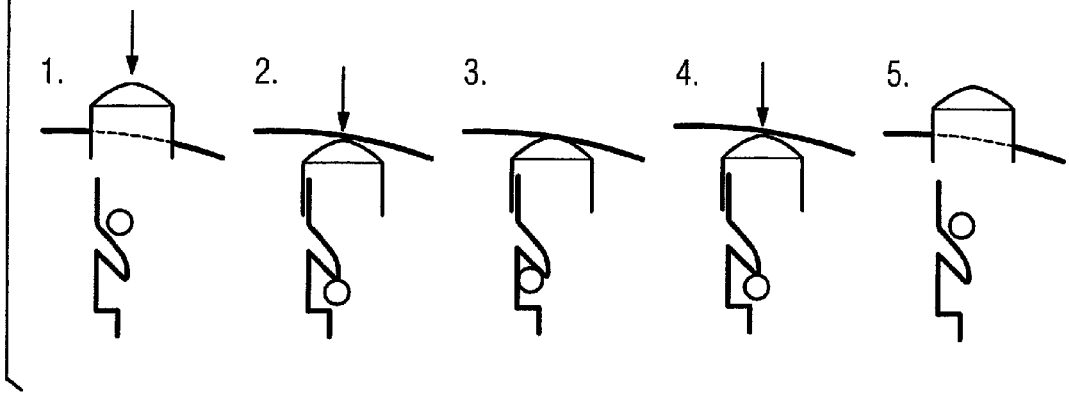
FIG. 9 is a schematic representation of the mode of operation of the embodiment according to FIG. 8.

A further embodiment of the inventive hearing device 3 is shown in FIG. 8. Here the contact element 37 is executed as a pin that is associated with a locking mechanism and a spring element 35. The locking mechanism is formed by a locking element 39 and a locking projection 38. The locking pin 38 can engage in a detent formed by a locking element 39. Similar to the pushbutton of a ballpoint pen, the contact pin 37 can be moved from the first position into the second position and back by external pressing, which is schematically shown in FIG. 9: 1. the contact pin is pushed downward; 2. the contact pin is fully inside the hearing device (=operating position); 3. the locking element holds the contact pin in position; 4. new pressing releases the locking projection, the contact pin moves upward out of the housing; 5. the contact element protrudes from the housing (charging position) and is borne elastically.

The inventive hearing device and associated charging device can be provided both for in-the-ear (ItE) hearing devices and behind-the-ear (BtE) hearing devices. The charging device can also have a display device (for example an LED) that indicates the charging status of the hearing device. In order to switch the hearing device into a charging operating state during the charging procedure, the operating current could be drawn to a specific level upon placement of the hearing device over the charging contacts, causing the charging mode to be initiated. It is also conceivable for the hearing device to then be reactivated by means of remote control after successful charging and removal from the charging device.

Although modifications and changes may be suggested by those skilled in the art, it is the intention of the inventors to embody within the patent warranted hereon all changes and modifications as reasonably and properly come within the scope of their contribution to the art.

We claim as our invention:

1. A hearing device comprising:

a device housing;

a plurality of electrical components in said device housing and a rechargeable battery pack in said device housing that supplies power to said electrical components;

at least one contact element in electrical connection with said battery pack, that is configured to engage an external charging device; and said at least one contact element being movably mounted in said device housing and being pressed onto charging contact with said external charging device during a charging state by an application of positive force to said at least one contact element, said at least one contact element being located in a first position relative to said device housing during a non-charging state and being moved into a second position relative to said device housing during a charging state.

2. A hearing device as claimed in claim 1 wherein said contact element has an outer surface that terminates substantially flush with an external housing surface of said device housing in said first position.

3. A hearing device as claimed in claim 1 wherein said contact element in said second position protrudes from said device housing.

4. A hearing device as claimed in claim 3 comprising a spring element in mechanical engagement with said contact element and a locking mechanism that locks said contact element in said second position, said contact element being pressed against a force of said spring element from said first position into said second position, and being locked in said second position by said locking mechanism, and being released from said second position by said locking mechanism upon a subsequent pressing of said contact element, and being returned to said first position by said force of said spring element.

5. A hearing device as claimed in claim 1 wherein said device housing has a receptacle in which said contact element is movable, said contact element being fully contained in said receptacle in said second position.

6. A hearing device as claimed in claim 5 comprising a spring element in mechanical engagement with said contact element and a locking mechanism that locks said contact element in said second position, said contact element being pressed against a force of said spring element from said first position into said second position, and being locked in said second position by said locking mechanism, and being released from said second position by said locking mechanism upon a subsequent pressing of said contact element, and being returned to said first position by said force of said spring element.

7. A hearing device as claimed in claim 1 comprising a guidance device that guides movement of said contact element between said first and second positions.

8. A hearing device as claimed in claim 1 comprising a return element that mechanically returns said contact element into said first position upon ending of said charging state.

9. A hearing device as claimed in claim 1 comprising a switch that moves said contact element from said first position into said second position, and vice versa.

10. A hearing device as claimed in claim 9 wherein said switch comprises an actuation surface configured to engage said external charging device, said switch being actuated upon said actuation surface coming into contact with said external charging device.

11. A hearing device as claimed in claim 1 wherein said contact element is a contact pin.

* * * * *